US006305432B1

(12) United States Patent
Sacks et al.

(10) Patent No.: US 6,305,432 B1
(45) Date of Patent: Oct. 23, 2001

(54) WIRE MESH HAVING FLATTENED STRANDS

(75) Inventors: Abraham Sacks; Jeffrey L. Sacks, both of Vancouver; William Spilchen, White Rock; Narcis Rugina, New Westminster; Harold R. Davis, Vancouver, all of (CA)

(73) Assignee: Sacks Industrial Corp., Vancouver (CA)

( * ) Notice: Subject to any disclaimer, the term of this patent is extended or adjusted under 35 U.S.C. 154(b) by 0 days.

(21) Appl. No.: 09/729,207

(22) Filed: Dec. 5, 2000

(30) Foreign Application Priority Data

Jun. 19, 2000 (CA) ..... 2311916

(51) Int. Cl.[7] ..... B21F 27/08; E01C 11/16; D03D 15/02

(52) U.S. Cl. ..... 139/425 R; 404/70; 140/107; 52/664; 245/2

(58) Field of Search ..... 245/11, 2; 404/70, 404/134; 52/633, 664, 669; 139/425 R; 140/5–7, 92.1, 107

(56) References Cited

U.S. PATENT DOCUMENTS

| | | | | |
|---|---|---|---|---|
| 600,352 | * | 3/1898 | Bell | 139/425 R |
| 749,714 | * | 1/1904 | Barnes et al. | 139/425 R |
| 1,767,814 | * | 6/1930 | Reynolds | 139/425 R |
| 2,269,869 | * | 1/1942 | Specht | 139/425 R |

* cited by examiner

*Primary Examiner*—Andy Falik
(74) *Attorney, Agent, or Firm*—Oyen Wiggs Green & Mutala

(57) ABSTRACT

The invention relates to metal wire mesh having a plurality of longitudinal wires and a plurality of transverse wires. The longitudinal wires of the mesh are provided with shaped areas wherein the moment of inertia of said shaped areas about the neutral axis parallel to the plane of the mesh is 90 percent or less of the moment of inertia of said shaped areas about the neutral axis vertical to the plane of the mesh. This substantially reduces the problem of curvature set when metal wire mesh is rolled for packaging or transport and attempts are made to unroll prior to use.

40 Claims, 6 Drawing Sheets

WIRE MESH HAVING FLATTENED STRANDS

FIELD OF THE INVENTION

This invention relates to metal wire mesh. In particular, this invention relates to an improved structure for metal wire mesh to avoid the problem of curvature set when wire mesh is bent or wound in rolls.

BACKGROUND OF INVENTION

Many metal wire mesh products comprise a plurality of round longitudinal wires and a plurality of round transverse wires forming a plurality of rectangles. These products include welded wire meshes or wire laths, or other meshes that are twisted or fastened together in some manner at the intersections of the longitudinal and transverse wires. Examples of the first type are welded concrete reinforcing mesh, welded utility mesh, or welded stucco reinforcing lath. An example of the latter type is wire fencing.

For wire meshes of lighter wire sizes, it is common to wind these products into rolls. Rolls provide the advantage of a convenient package containing a considerable length of continuous material. Rolls can provide a compact and dense package, which is important for warehousing and shipping considerations. Further, wire mesh products formed into rolls can easily be placed on pallets for handling.

However, one of the drawbacks of rolling metal wire mesh products into rolls is that the longitudinal wires can take on a curvature set. For the user, such curvature set often presents a problem. When unrolling the product, the longitudinal wires retain a memory and a tendency to spring back to the rolled position. As most products are intended to lay or run flat, or in a straight line, the user must work against the tendency of the mesh to spring back to its rolled condition. This can be dangerous for the user, and makes it difficult to flatten the product as it is being applied or while the wire mesh is being further processed.

The curvature set is caused when the longitudinal wires are bent into the roll shape. The resulting curvature stretches the outside fibres of the metal wires beyond their elastic limit. The metal at the outer side of each wire becomes plastically deformed and retains the memory of this deformation. The curvature set is primarily a function of the wire size, the ductility of the metal and the radius of the roll.

To partially counter the problem of curvature set, some manufacturers have produced rolls having larger core diameters. This approach can reduce the problem to some extent but will not eliminate it entirely, unless inordinately large roll core diameters are used. This approach also results in larger outer roll diameters for the same length of product and therefore, the advantages of a dense package are not fully achieved.

Producing and packaging metal wire mesh in sheets avoids the curvature set that is created in the roll formation process but this approach loses some of the benefits which rolls provide. Wire mesh products in sheet form require additional packaging to protect the product and to create a package that can be handled by a forklift. Another disadvantage of sheets is that they can be more difficult for the user to handle in the field. A further disadvantage for certain applications such as wire stucco reinforcement is that sheets require additional end overlaps in the construction of a wall. This reduces both the efficiency of application and the quality of installation in comparison to rolls which contain longer continuous lengths.

U.S. Pat. Nos. 3,632,054, 3,688,810, 3,814,144, 4,077,731, 4,557,633, and 5,009,545 all acknowledge the problems associated with wire meshes in rolls and disclose various apparatus and methods for straightening, backbending, decontouring the web and flattening the roll, so that when it is unrolled the tendency of the wire mesh to reassume a rolled position is substantially eliminated. These approaches compensate for the problem of curvature set but they do not avoid the introduction of curvature set in the first place.

The object of the present invention is to reduce the curvature set of longitudinal wires in metallic wire meshes that are wound into rolls for packaging or transport and are intended to be unrolled prior to use.

The present invention has application to wire mesh comprising a plurality of longitudinal strands and a plurality of transverse strands forming a plurality of rectangles, where the longitudinal strands are continuous and the transverse strands are either continuous or segmented, and the mesh or fencing is held together by welding or mechanical fastening at each intersection.

SUMMARY OF THE INVENTION

According to the invention, the longitudinal wires of a metal wire mesh are shaped so that instead of their cross section being round, the cross section is relatively shorter in one direction than in the other. For a round shape, the moment of inertia is the same around the horizontal and vertical neutral axes. The objective of the invention is to change the profile of the longitudinal wires so that the moment of inertia around the horizontal axis is less than the moment of inertia around the vertical axes (for the purpose of defining horizontal and vertical, the above description is based on the mesh laying in a horizontal plane). This includes a flattened profile, an oval profile, a convex profile, or any other profile that generally reshapes the round wire to a degree sufficient to meet the desired objective.

This shaping of the wire from drawn round wire, either coated or uncoated, or from a hot rolled wire rod can occur either before, during or after manufacturing of the wire mesh. The shaping of the wires can also be continuous or intermittent along the length of each longitudinal wire or in relation to adjacent longitudinal wires.

By reducing the moment of inertia of the longitudinal wires in the direction as described, the wire mesh can be rolled into a roll and some, or all, of the product in the roll can be wound up without acquiring curvature set. Thus, when the product is unrolled the wire mesh can easily be returned either to the flat state or have a desired amount of curvature.

It is a further object of the present invention to provide metal wire mesh that can be packaged in rolls and then subsequently unwound and that will then substantially flatten itself without the need for separate apparatus.

The factors that determine whether the longitudinal wires of a metal wire mesh take on any circular memory is the roll diameter and horizontal moment of inertia of the longitudinal wires. The manufacturer has the option of changing these attributes to either totally eliminate circular memory, or use some other combinations to both reduce circular memory and obtain other packaging benefits.

With minimal curvature set, greater density of rolled product can be achieved for warehousing and shipping.

The invention also provides an advantage in certain applications of providing a product that is more supple, such being an important feature for products such as stucco wire reinforcement lath or concrete reinforcing mesh in sheet form that need to be temporarily bent to get around corners. It will therefore be appreciated that the wire mesh structure of the invention will have application not only to metal wire mesh product which is intended to be packaged in rolls, but also to product in sheet form that is likely to be subject to temporary bending.

This invention can be applied to wire meshes made of any metallic material including bright, galvanized, plated or coated iron, carbon or alloyed steel; or from aluminum, stainless steel, brass, or other non-ferrous metals.

In one aspect, the invention is a metal wire mesh consisting of a plurality of longitudinal wires and a plurality of transverse wires, said wire mesh being wound into rolls along the length of said longitudinal wires and intended to be unrolled prior to use. The longitudinal wires have shaped areas wherein the moment of inertia of said shaped areas about the neutral axis parallel to the plane of the mesh is 90 percent or less of the moment of inertia of the shaped areas about the neutral axis vertical to the plane of the mesh. In another aspect, the invention is such wire mesh in sheet form.

According to the invention, a significant proportion of the longitudinal wires are shaped, namely at least 10%.

The advantages of the invention may be achieved when a significant proportion of the length of each shaped longitudinal wire is shaped, preferably at least 15%.

In another aspect of the invention, the areas at the intersections of the longitudinal and transverse wires are not shaped but the areas between the intersections are shaped.

Other aspects of the invention will be appreciated by reference to the detailed description which follows as well as to the claims.

DETAILED DESCRIPTION OF THE PREFERRED AND ALTERNATIVE EMBODIMENTS OF THE INVENTION

Figure 1:
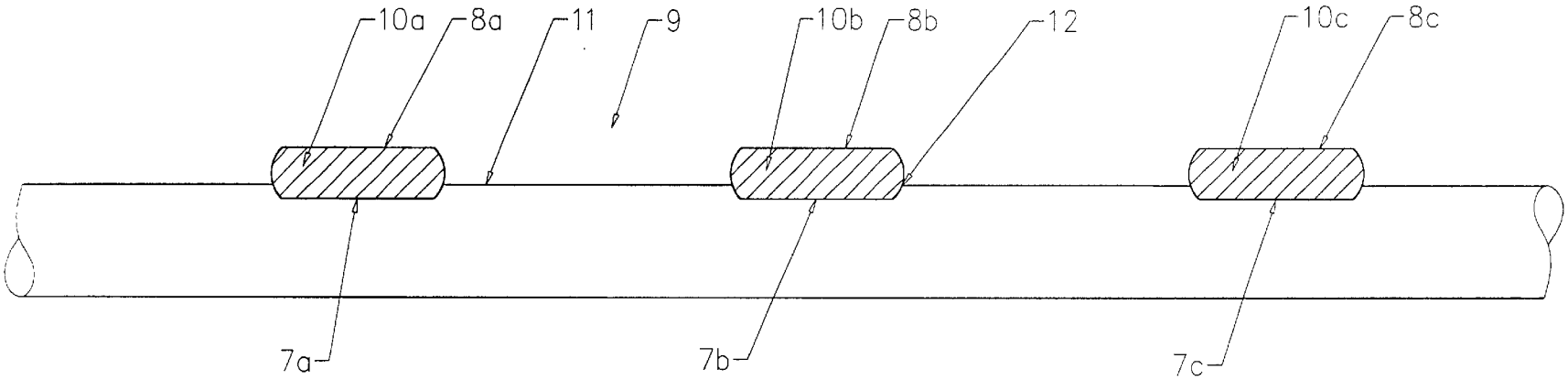
FIG. 1 is a side sectional view of a welded wire mesh with flattened longitudinal strands in accordance with the present invention.

FIG. 1 shows a metal wire mesh 9 in a preferred form of the present invention. The mesh 9 includes a series of transverse strands 11 and a series of longitudinal strands 10*a,* 10*b,* 10*c* arranged in a generally planar configuration and extending laterally and generally parallel to one another. Typically the mesh would be produced in lengths and the number of longitudinal strands would be a function of the spacing of the strands and the overall width of the product. In the case of welded stucco reinforcement lath, the width ranges from 36 inches to 54 inches, although the invention is of course not limited to these widths. The number of transverse strands is determined by the spacing of the transverse strands and the length of the package. Typically, the length of product is 4 feet to 20 feet for sheet products, and 100 feet to 150 feet for rolled products, although again the invention is not limited to these lengths.

As shown in FIG. 1, each of the longitudinal strands 10*a,* 10*b,* 10*c* has a flattened profile and includes a flat portion 8*a,* 8*b,* 8*c* on the outward face and a flat portion 7*a,* 7*b,* 7*c* on the inward face. These flat portions lie generally in the plane of the mesh or lath.

At the intersection of the transverse strands 11 and the longitudinal strands 10*a,* 10*b,* 10*c,* the strands are joined together by resistance welding. Resistance welding techniques are well known and are utilized in many wire fabricating applications. During the welding process, there is a setting down of the intersecting strands into each other as shown at point 12.

Figure 2:
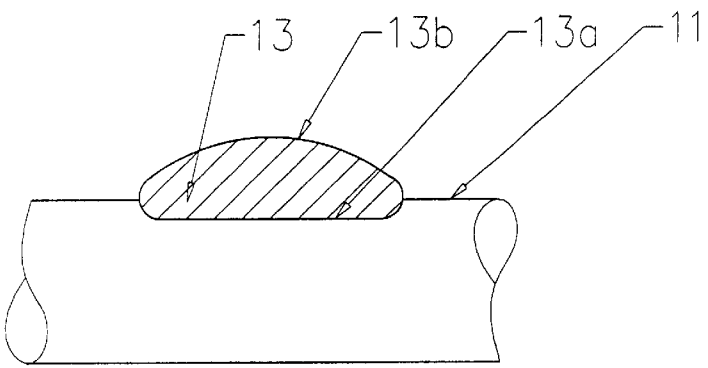
FIG. 2 is a side sectional view of a welded wire mesh with longitudinal strands that are flattened on one side and rounded on the opposite side in accordance with the present invention.

FIG. 2 show an alternate form of the present invention in which a wire mesh is constructed in much the same manner as that of FIG. 1, except that the longitudinal strands 13 have one side flat 13*a* and one rounded side 13*b*. In FIG. 2, the flat side 13*a* is placed inward against the transverse wire 11 and the rounded side is facing outward from the plane of the mesh. Although not shown in a figure, the opposite combination of placing the rounded side 13*b* against the transverse wire 11 and having the flat side 13*a* facing outward from the plane of the mesh is another alternative embodiment.

Figure 3:
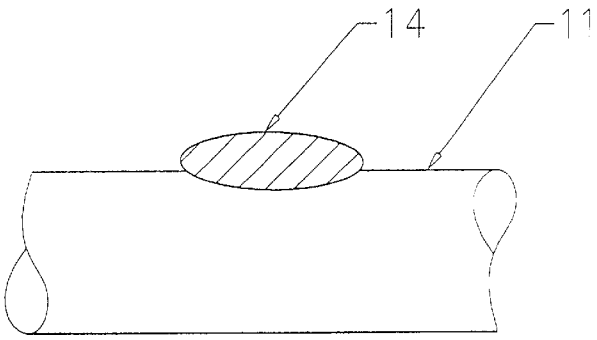
FIG. 3 is a side sectional view of a welded wire mesh with oval longitudinal strands in accordance with the present invention.

FIG. 3 shows another alternate form of the present invention in which a wire mesh is constructed in much the same manner as that of FIG. 1, except that the longitudinal strands 14 have an oval shape.

Figure 4:
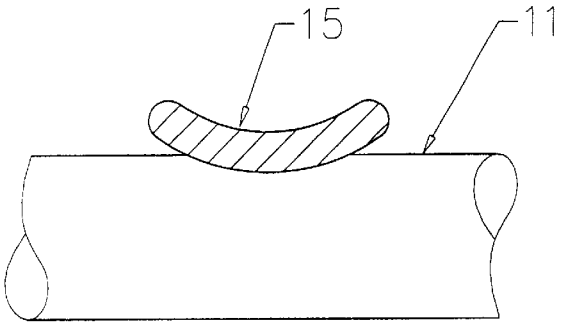
FIG. 4 is a side sectional view of a welded wire mesh with convex shaped longitudinal strands in accordance with the present invention.

FIG. 4 shows another alternate form of the present invention in which a wire mesh is constructed in much the same manner as that of FIG. 1, except that the longitudinal strands 15 have a convex shape.

Figure 5:
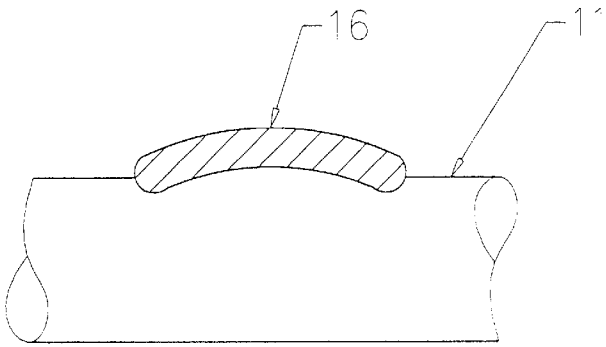
FIG. 5 is a side sectional view of a welded wire mesh with concave shaped longitudinal strands in accordance with the present invention.

FIG. 5 shows another alternate form of the present invention in which a wire mesh is constructed in much the same manner as that of FIG. 1, except that the longitudinal strands 16 have a concave shape.

Figure 6A:
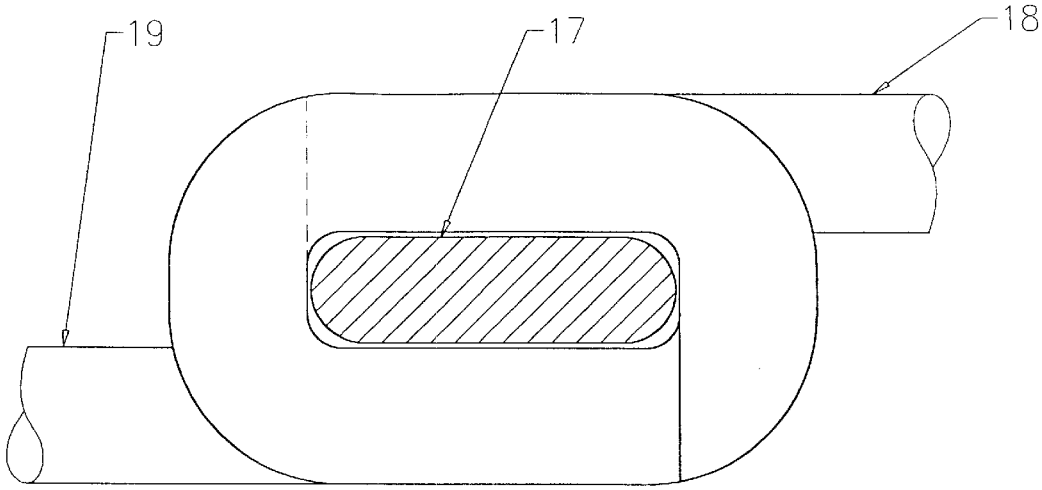
FIG. 6A is a side sectional view of a hinge joint metal wire fence with flattened longitudinal strands in accordance with the present invention.
Figure 6B:
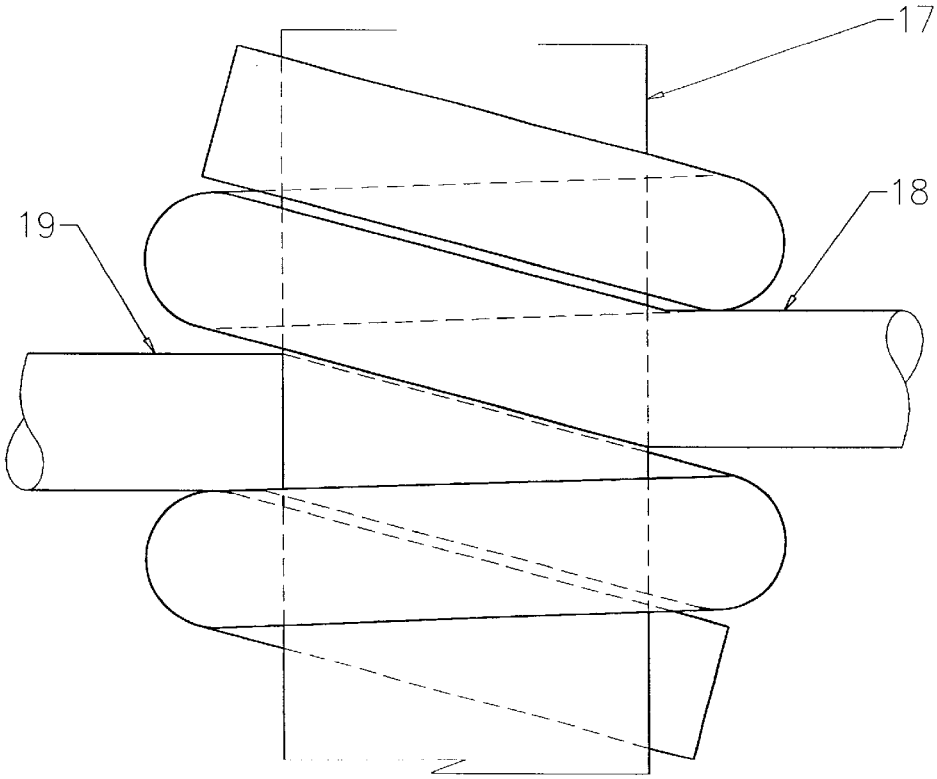
FIG. 6B is a front view of the hinge joint fence as shown in FIG. 6A.

FIG. 6A shows a further embodiment, in which wire fencing, referred to as a hinge joint style of fencing, is made of a series of longitudinal strands 17 and a series of transverse strands 18, 19. The transverse strands 18, 19 are called stay wires and are made of individual wire segments 18, 19 between each longitudinal strand 17. At each intersection, the stay wires 18, 19 are twisted around the longitudinal strand 17 to form a tight twist to hold the fence together. In this embodiment of the present invention, FIG. 6A shows that the fence is constructed with longitudinal strands 17 which are flattened. The two flat surfaces are oriented so that the flat surfaces lie generally in the same plane as the fence plane. FIG. 6B shows a front view of the hinge joint fence intersection shown in FIG. 6A.

Figure 7A:
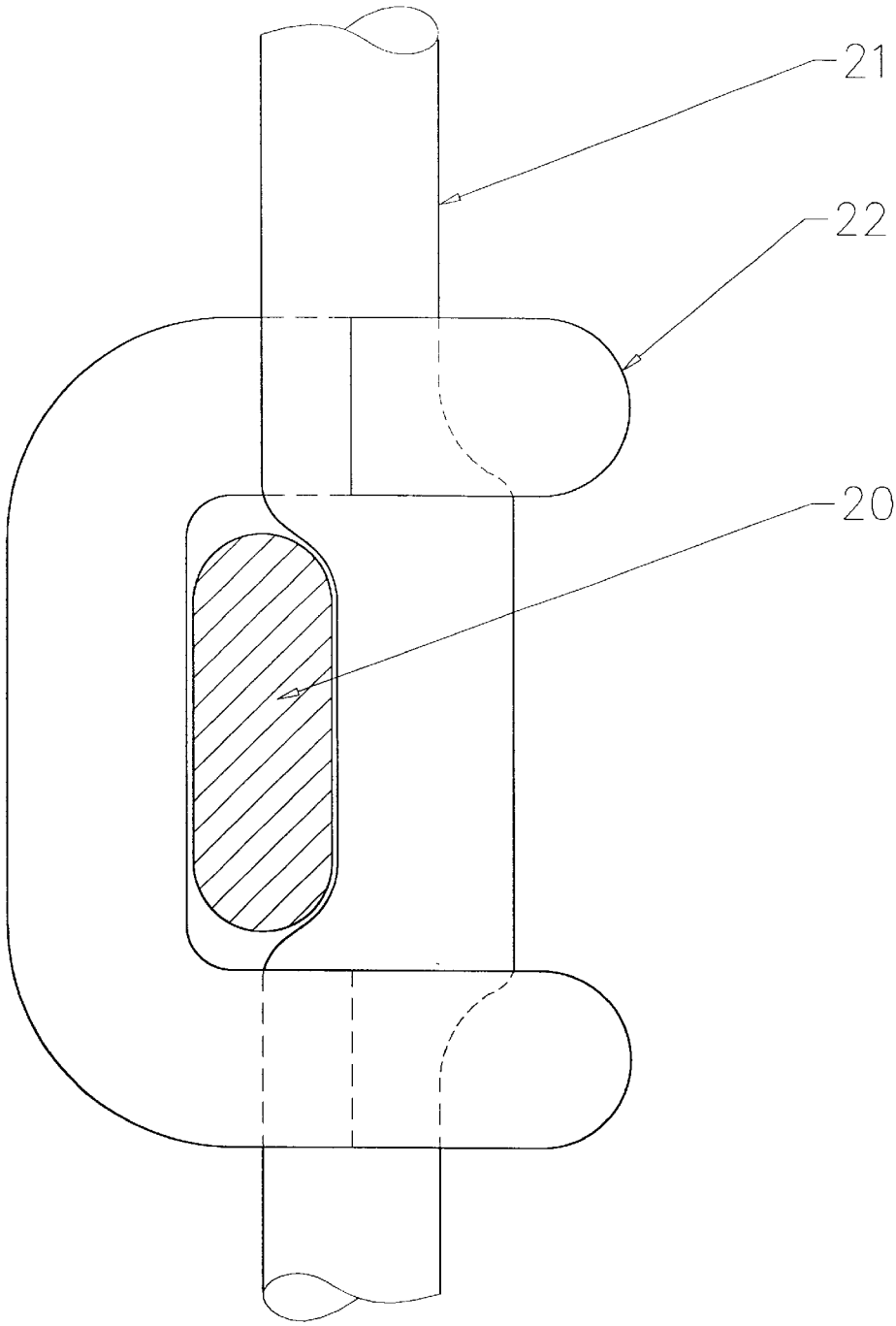
FIG. 7A is a side sectional view of a metal wire fence utilizing locking wires and with flattened longitudinal strands in accordance with the present invention.
Figure 7B:
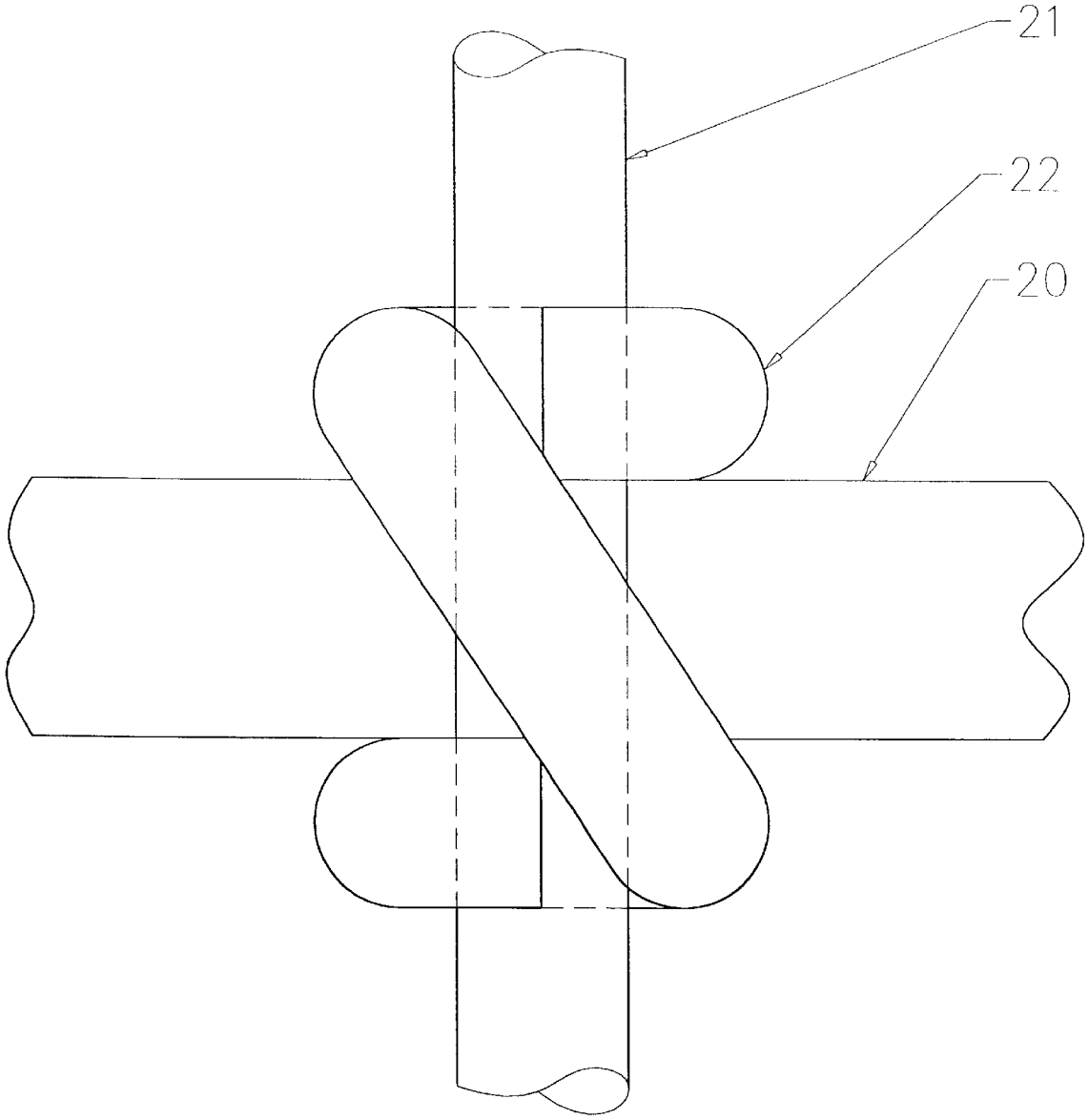
FIG. 7B is a front view of the wire fence as shown in FIG. 7A.

FIG. 7A shows another embodiment in which wire fencing, referred to as a 'stiff stay' style of fence which is made up of a series of longitudinal strands 20, a series of transverse strands 21, and a locking wire segment or ring 22 at each intersection. In contrast to the fencing in FIG. 6, the transverse strands 21, called stay wires, are continuous across the width of the fence. At each intersection, the locking wire segment or ring 22 locks the longitudinal strands 20 and stay wires 21 together. In this embodiment of the present invention, the fence is constructed of longitudinal strands 20 which are flattened. The two flat surfaces are oriented so that the flat surfaces lie generally in the same plane as the fence plane. FIG. 7B shows a front view of the fence intersection shown in FIG. 7A. As further shown in FIG. 7A, the stay wire 21 may be crimped at each intersection to create an offset to prevent the longitudinal strands from slipping vertically.

Figure 8:
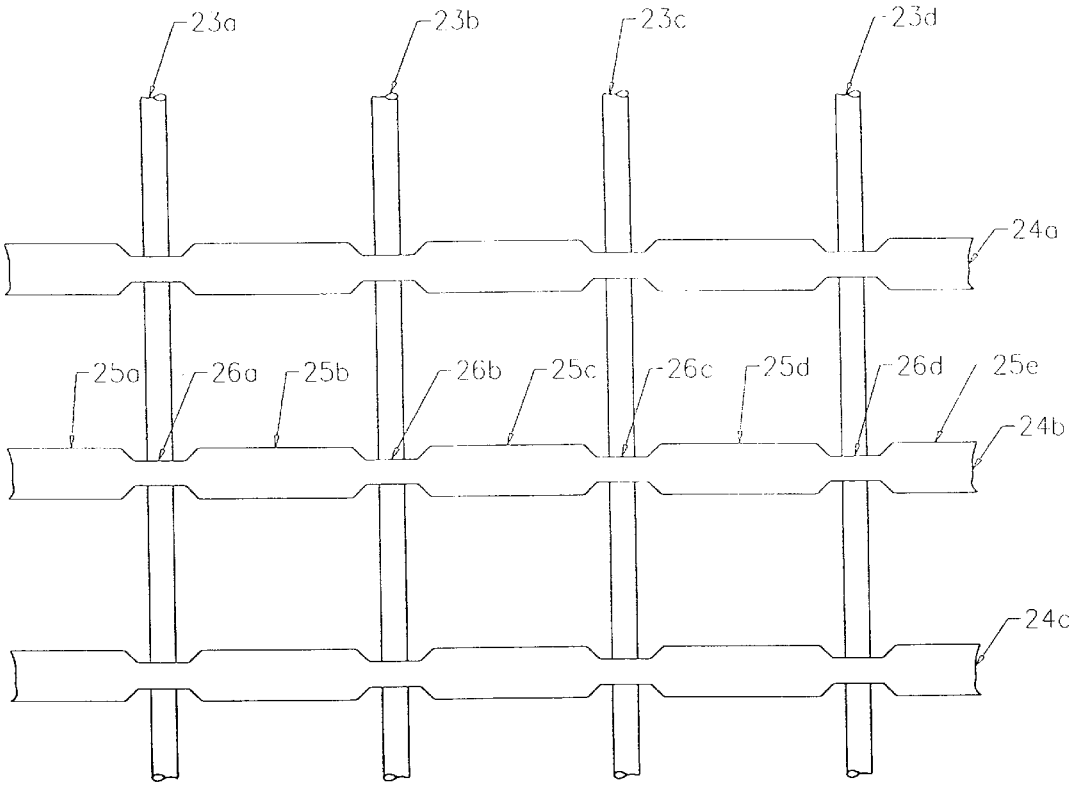
FIG. 8 is a front view of a metal wire mesh that shows intermittent flattening of the longitudinal strands in accordance with the present invention.

With each of the embodiments shown of the present invention up this point, the shaping of the longitudinal strands has been continuous along the length of the longitudinal strand. However, it is not necessary to shape the longitudinal strands in uninterrupted fashion along their entire length to achieve some or all of the desired benefits. Accordingly, as shown in FIG. 8, Fig the shaping, in this case flattening, of the longitudinal strands 24*a*, 24*b*, 24*c* is not continuous but is intermittent. The longitudinal strands 24*a*, 24*b*, 24*c* are shaped as at 25*a*, 25*b*, 25*c*, 25*d*, 25*e* between the transverse strands 23*a*, 23*b*, 23*c*, 23*d*. The sections 26*a*, 26*b*, 25*c*, 25*d* between the flattened sections 25*a*, 25*b*, 25*c*, 25*d*, 25*e* can be round or any other shape. The possible combinations of patterns and spacing for shaped and unshaped profiles along the length of the longitudinal strands is infinite. For any ratio whereby more than 15% of the length of the longitudinal strands are shaped, the desired benefits of the present invention would be achieved and are considered to be within the scope of the invention.

Similarly, it is not necessary to shape all the longitudinal strands to achieve the benefits of the present invention. For any ratio whereby more than 10% of the longitudinal strands are shaped more than 15% of their length, the desired benefits of the present invention would be achieved and is considered to be within the scope of the invention.

The preferred embodiments that have been used as examples have utilized preferred shapes of the longitudinal strands. Since variations in these shapes may also obtain the desired benefits of the present invention, it is useful to identify the characterizing parameters of the present invention.

Figure 9:
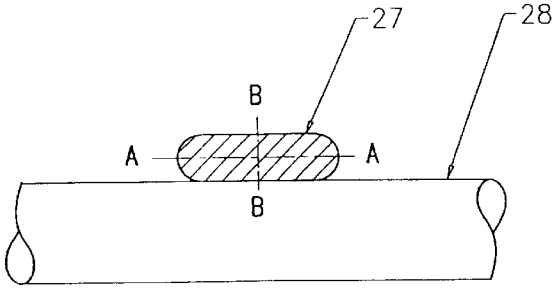
FIG. 9 is a side sectional view of a wire intersection showing the relationship of the axis of the shaped longitudinal strands in relation to the plane of the mesh in accordance with the present invention.

The moment of inertia (I) of a cross sectional area is a well known concept in engineering and is used in beam calculations. Every cross section has two principal axes passing through the center of gravity, and these two axes are at right angles to each other. A moment of inertia may be calculated in relation to any given axis. FIG. 9 shows a cross sectional view of a longitudinal strand 27 and a transverse strand 28. The two principal axes of the longitudinal strand 27 are shown as AA and BB. Axis AA is parallel to the plane of the wire mesh, lath, fence, or screen and axis BB is perpendicular to the plane of the wire mesh, lath, fence or screen. For a round shape, the moment of inertia is the same about each axis and is determined by the formula $I=\pi d^4/64$. For other common shapes, there are specific formulas that have been developed to calculate I, and there are accepted methods to calculate I for unusual shapes.

Any shape of the longitudinal strands having a moment of inertia of the cross section about the neutral parallel to the plane of the mesh (AA) which is 90% or less than the moment of inertia about the neutral axis normal to the plane of the mesh (BB) is within the scope of the present invention.

Finally, while the embodiments shown and described herein disclose specific preferred shapes, it will be appreciated that any shape of the longitudinal strands in each embodiment would be subject to the present invention if the shaping falls within the limits as stated and ratios of the moments of inertia as stated.

While the invention has been described in preferred forms only, it will be obvious to those skilled in the art that modifications may be made thereto without departing from the spirit and scope of the invention as set forth in the following claims.

What is claimed is:

1. A metal wire mesh consisting of a plurality of longitudinal wires and a plurality of transverse wires, said wire mesh being wound into rolls along the length of said longitudinal wires and intended to be unrolled prior to use, wherein said longitudinal wires have shaped areas wherein the moment of inertia of said shaped areas about the neutral axis parallel to the plane of the mesh is 90 percent or less of the moment of inertia of said shaped areas about the neutral axis vertical to the plane of the mesh.

2. A wire mesh according to claim 1 wherein a significant proportion of the longitudinal wires are shaped.

3. A wire mesh according to claim 2 wherein said significant proportion is at least 10%.

4. A wire mesh according to claim 3 wherein a significant proportion of the length of each shaped longitudinal wire is shaped.

5. A wire mesh according to claim 4 wherein at least 15% of the length of the shaped longitudinal wires is shaped.

6. A wire mesh according to claim 1 wherein said shaped areas comprise a significant proportion of the length of each of said longitudinal wires.

7. A wire mesh according to claim 6 wherein said significant proportion is at least 15%.

8. A wire mesh according to claim 7 wherein said shaped areas of said longitudinal wires are in the areas between adjacent transverse wires and the areas of said longitudinal wires that are not shaped are the areas at the intersections between said longitudinal and transverse wires.

9. A wire mesh according to claim 1 wherein the shape of the longitudinal wires is selected from among the following shapes: flattened, oval, convex, concave, half round.

10. The wire mesh according to claim 1 wherein said mesh is welded mesh.

11. The wire mesh according to claim 10 wherein said mesh is welded stucco reinforcement lath.

12. The wire mesh as defined in claim 10 wherein said mesh is welded wire concrete reinforcing mesh.

13. The wire mesh according to claim 10 wherein said mesh is a welded screen.

14. The wire mesh according to claim 1 wherein said mesh is hinge joint type mesh.

15. The wire mesh according to claim 1 wherein said mesh is stay stiff fencing.

16. A wire mesh according to claim 1 or 7 in which said shape is a flattened shape and said mesh is welded stucco reinforcement lath.

17. A mesh according to claim 1 or 7 in which said shape is a flattened shape and said mesh is welded wire concrete reinforcing mesh.

18. A mesh according to claim 1 or 7 wherein said shape is a flattened shape and said mesh is a welded screen.

19. The metal wire mesh of any one of claims 1, 2, 3, 4, 6, 7, 5, 9, 10, 11, 12 or 8 wherein the wire mesh is a non-woven mesh.

20. A metal wire mesh comprising a plurality of longitudinal wires and a plurality of transverse wires, said wire mesh being wound into rolls along the length of said longitudinal wires and intended to be unrolled prior to use, wherein said longitudinal wires have shaped areas wherein the moment of inertia of said shaped areas about the neutral axis parallel to the plane of the mesh is 90 percent or less of the moment of inertia of said shaped areas about the neutral axis vertical to the plane of the mesh.

21. A wire mesh according to claim 20 wherein a significant proportion of the longitudinal wires are shaped.

22. A wire mesh according to claim 21 wherein said significant proportion is at least 10%.

23. A wire mesh according to claim 22 wherein a significant proportion of the length of each shaped longitudinal wires is shaped.

24. A wire mesh according to claim 23 wherein at least 15% of the length of the shaped longitudinal wires is shaped.

25. A wire mesh according to claim 20 wherein said shaped areas comprise a significant proportion of the length of each of said longitudinal wires.

26. A wire mesh according to claim 25 wherein said significant proportion is at least 15%.

27. A wire mesh according to claim 26 wherein said shaped areas of said longitudinal wires are in the areas between adjacent transverse wires and the areas of said longitudinal wires that are not shaped are the areas at the intersections between said longitudinal and transverse wires.

28. A mesh according to claim 26 in which said shape is a flattened shape and said mesh is welded wire concrete reinforcement mesh.

29. A mesh according to claim 26 wherein said shape is a flattened shape and said mesh is a welded screen.

30. A wire mesh according to claim 20 wherein the shape of the longitudinal wires is selected from among the following shapes: flattened, oval, convex, concave, half round.

31. The wire mesh according to claim 20 wherein said mesh is welded mesh.

32. The wire mesh according to claim 31 wherein said mesh is welded stucco reinforcement lath.

33. The wire mesh as defined in claim 31 wherein said mesh is welded wire concrete reinforcing mesh.

34. The wire mesh according to claim 20 wherein said mesh is hinge joint type mesh.

35. The wire mesh according to claim 20 wherein said mesh is stay stiff fencing.

36. The wire mesh according to claim 20 wherein said mesh is welded screen.

37. A wire mesh according to claim 20 in which said shape is a flattened shape and said mesh is welded stucco reinforcement lath.

38. A mesh according to claim 20 in which said shape is a flattened shape and said mesh is welded wire concrete reinforcement mesh.

39. A mesh according to claim 20 wherein said shape is a flattened shape and said mesh is a welded screen.

40. The metal wire mesh of any one of claims 20, 21, 22, 23, 25, 26, 24, 30, 31 32, 33, 36, 27, 37, 38, 28, 39 or 29 wherein the wire mesh is a non-woven mesh.

* * * * *